US005245691A

United States Patent [19]

Wu

[11] Patent Number: 5,245,691

[45] Date of Patent: Sep. 14, 1993

[54] ELECTRIC HEATER CIRCUIT

[75] Inventor: Jimmy Wu, Hsing-Tien City, Taiwan

[73] Assignee: Holmes Products Corp., Milford, Mass.

[21] Appl. No.: 375,411

[22] Filed: Jul. 3, 1989

[51] Int. Cl.[5] ..... H05B 1/02

[52] U.S. Cl. ..... 392/365; 392/358

[58] Field of Search ..... 219/364, 363, 358; 392/365

[56] References Cited

U.S. PATENT DOCUMENTS

| | | | |
|---|---|---|---|
| 4,398,082 | 8/1983 | Johannsen | 392/365 |
| 4,518,847 | 5/1985 | Horst | 392/358 |
| 4,755,653 | 7/1988 | Townsend | 392/365 |
| 4,844,072 | 7/1989 | French | 219/490 |

*Primary Examiner*—Teresa J. Walberg

*Attorney, Agent, or Firm*—Kriegsman & Kriegsman

[57] ABSTRACT

An electric heater circuit for an electric heater includes a set of heater coils for generating heat, a normally closed temperature sensitive switch for deactivating the heater coils when the temperature inside the electric heater exceeds a predetermined threshold temperature, a normally closed tilt sensitive switch for deactivating the heater coils in response to tilting movement of the electric heater beyond a predetermined amount relative to a normal upright position, a light and buzzer combination for providing signals when either the temperature sensitive switch is opened as a result of the temperature inside the electric heater exceeding the predetermined threshold temperature or the tilt sensitive switch is opened as a result of tilting movement of the heater beyond the predetermined amount relative to the normal upright position, fan and an adjustable thermostat.

22 Claims, 1 Drawing Sheet

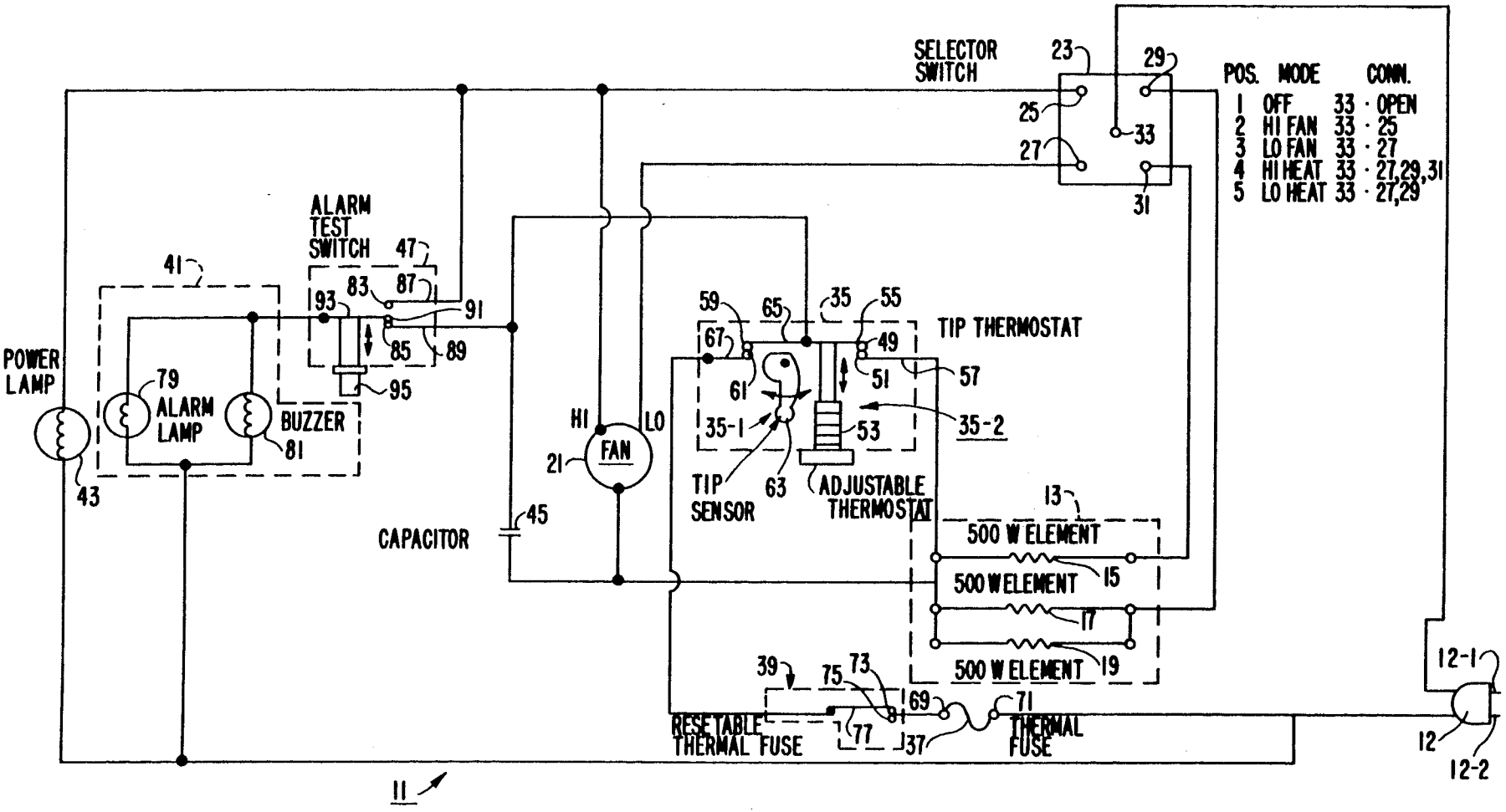
POS. MODE CONN.
1 OFF 33 · OPEN
2 HI FAN 33 · 25
3 LO FAN 33 · 27
4 HI HEAT 33 · 27,29,31
5 LO HEAT 33 · 27,29
SELECTOR SWITCH
TIP THERMOSTAT
ADJUSTABLE THERMOSTAT
TIP SENSOR
500 W ELEMENT
500 W ELEMENT
500 W ELEMENT
THERMAL FUSE
RESETABLE THERMAL FUSE
FAN
HI
LO
CAPACITOR
ALARM TEST SWITCH
BUZZER
ALARM LAMP
POWER LAMP

ELECTRIC HEATER CIRCUIT

BACKGROUND OF THE INVENTION

The present invention relates generally to an electric heater and more particularly to an electrical circuit for an electric heater which includes a heater coil, a signal indicator, a first switch for simultaneously deactivating the heater coil and activating the signal indicatator when the temperature inside the heater exceeds a predetermined value and a second switch for simultaneously deactivating the heater coil and activating the signal indicator means when the electric heater is tilted beyond a predetermined angle.

As used herein, the term "deactivating the heater coil" means reducing the current flow through the heater coil means so that the heat generated is negligible, at most. Also, the term "activating the signal indicator means" increasing the current flow through the signal indicator so that it is energized and outputting a detectable signal.

The need exists for a heater circuit for an electric heater which includes an arrangement for essentially turning off the heater in the event the heater is either overheated or tipped over and at the same time activating an alarm to indicate one (or both) of these faults has occurred.

The present invention accomplishes this in a unique manner with a minimum number of parts.

SUMMARY OF THE INVENTION

An electric heater circuit for an electric heater constructed according to the teachings of the present invention includes heater means for generating heat, a temperature sensitive switch for deactivating the heater means when the temperature inside the electric heater exceeds a predetermined threshold temperature, the temperature sensitive switch being normally closed, a tilt sensitive switch for deactivating the heater means in response to tilting movement of the electric heater beyond a predetermined amount relative to a normal upright position, the tilt sensitive switch being normally closed, and signal means for providing a signal when either the temperature sensitive switch is opened as a result of the temperature inside the electric heater exceeding the predetermined threshold temperature or the tilt sensitive switch is opened as a result of tilting movement of the heater beyond the predetermined amount relative to the normal upright position.

Various features and objects advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts:

FIG. 1 is a schematic of an electric heater circuit for an electric heater constructed according to the teachings of the present invention.

DETAILED DESCRIPTION OF PREFERRED EMBODIMENTS

Referring now to the drawings, there is shown in FIG. 1 a schematic of an electric heater circuit for an electric heater constructed according to the teachings of the present invention, the electric heater circuit being identified by reference numeral 11.

Heater circuit 11 includes an input plug 12 which may be connected to an external power source (not shown). Plug 12 has a pair of poles 12-1 and 12-2.

Heater circuit 11 includes a heater section 13 having first, second and third heater coils labelled 15, 17 and 19, respectively. Heater circuit 11 also includes a motor operated electric fan 21 that circulates air around and through electric heater 11 to increase its effectiveness. Fan 21 can operate at either a high speed or a low speed.

Heater coils 15, 17 and 19 and electric fan 21 are controlled by a selector switch 23. Selector switch 23 is five position rotary type switch that includes five terminals labelled 25, 27, 29, 31 and 33. Terminal 33 is connected to a first pole 12-1 of plug 12. When the rotary element (not shown) is in position 1, terminal 33 is not electrically connected to any of terminals 25, 27, 29 and 31 and the electric heater is in an "off" mode (i.e. neither heater section 13 nor fan 21 are "on"). When the rotary element is in position 2, terminal 33 is connected to terminal 25. In this position, heater section 13 is in an "off" mode and electric fan 21 is in a high power mode. When the rotary element is in position 3, terminal 33 is connected to terminal 27, in which case heater section 13 is in an "off" mode and electric fan 21 is in a low power mode. When the rotary element is in position 4, terminal 33 is connected to terminals 27, 29 and 31 in which case, electric fan 21 is in a low power mode and the heater section 13 is in a high heat mode. When the rotary element is in position 5, terminal 33 is connected to terminals 27 and 29, electric fan 21 is in a low power mode and heater section is in a low heat mode.

Heater circuit 11 further includes a tip thermostat 35, a permanent thermal fuse 37, a resettable thermal fuse 39, a signaling circuit 41, a power lamp 43, a capacitor 45 and a signaling circuit test switch 47.

Tip thermostat 35 is a combination tip sensor 35-1 and adjustable thermostat 35-2. The adjustable thermostat 35-3 is used to manually set the temperature above which heater section 13 is activated (i.e. turned on). The tip sensor 35-1 is used to detect tilting movement of the electric heater (not shown) in which the heater circuit 11 is mounted beyond a predetermined angle and cause heating circuit 13 and fan 21 to be deactivated (i.e. turned off) when such tilting movement is detected. The adjustable thermostat 35-2 of tip thermostat 35 includes a pair of contacts 49 and 51 and a control 53. Contact 49 is mounted on a movable arm 55 while contact 51 is mounted on a fixed arm 57. Contacts 49 and 51 are normally closed. The tip sensor 35-1 of tip thermostat 35 includes a pair of contacts 59 and 61 and a pendulum 63. Contact 59 is mounted on a movable arm 65 while contact 61 is mounted on a fixed arm 67. Contacts 59 and 61 are normally closed.

Tip thermostats are well known in the art and are made in various constructions. See for example U.S. Pat. No. 3,201,548 and U.S. Pat. No. 3,936,786.

Permanent thermal fuse 37 is a two terminal device, the terminals being labelled 69 and 71. Permanent thermal fuse 37 is normally closed. Permanent thermal fuse 37 is used to permanently deactivate heater section 13 and fan 21 when the temperature inside the electric heater exceeds a predetermined temperature.

Resettable thermal fuse 39 temporarily disables heater section 13 and fan 21 when as long as the temperature inside the electric heater is in excess of a predetermined (set) temperature and includes a pair of contacts 73 and 75, contact 73 being mounted on a movable arm 77. Contacts 73 and 75 are normally closed. Resetable thermal fuse 39 and permanent thermal fuse 37 are connected in series between pole 12-2 of plug 12 and fixed arm 67 in tip thermostat 35.

The temperature at which fuse 37 permanently deactivates heater 13 and fan 21 is higher than the temperature at which fuse 39 temporarily deactivates these elements.

Signaling circuit 41 includes an alarm lamp 79 and a buzzer 81 which are connected in parallel. Signaling circuit 41 is used to indicate that the electric heater has been tilted beyond the predetermined angle (i.e. contacts 59 and 61 in tip switch 35-2 are opened) or that the temperature inside the electric heater is in excess of a predetermined temperature (i.e. contacts 73 and 75 are open) or both. Signaling circuit is activated as will hereinafter be explained.

Power lamp 43 is used to indicate there is power in electric circuit 11 i.e. the electric circuit is "on".

Test switch 47 is used to determine if signaling circuit 41 is operable and includes a pair of contacts 83 and 85 mounted on fixed arms 87 and 89 and a contact 91 mounted on a movable arm 93 to which is attached a button 95. Contact 91 is normally in contact with contact 85.

Capacitor 45 is sized so as to have an impedance that is much higher than that of the heater coils 15, 17 and 19. Also, power lamp 43 is sized so as to have a very high impedance relative to the impedance of signaling circuit 41.

Heater circuit 11 operates in the following manner.

Assume, for illustrative purposes, selector switch 23 is in the high heat position (i.e. the rotary element is in position 4).

If the temperature in the room where the electric heater is situated is lower than the temperature setting on adjustable thermostat 35-2 and there are no faults (i.e. the temperature inside the heater is not excessive; that is, not higher than the setting on fuse 39 and the heater is not tipped over), then adjustable thermostat 35-2, tip sensor 35-1, permanent thermal fuse 37 and resettable thermal fuse 39 will all be closed. Current will flow through power lamp 43, adjustable thermostat 35-2, tip sensor 35-1, permanent thermal fuse 37, resetable thermal fuse 39, fan 21 and coils 15, 17 and 19 capacitor 45 and signaling circuit 41. The current passing through coils 15, 17 and 19 will be sufficient to heat up coils 15, 17 and 19 and give off heat and the current passing through power lamp 43 and fan 21 will be sufficient to activate the components. On the other hand, the current passing through signaling circuit 41 will not be sufficient to cause lamp 79 to light up or buzzer 81 to sound. The current passing through capacitor 45 will be negligible.

If the temperature in the room exceeds the setting on adjustable thermostat 35-2, both occurrences, then adjustable thermostat 35-2 will open. If there are still no faults (i.e. excessive internal temperature or tilting over) then tip switch 35-1 and the two fuses 37 and 39 will still be closed. In this case, current will still flow through power lamp 43, capacitor 45 and coils 15, 17 and 19, fan 21 and signaling circuit 41. However, since the impedance of capacitor 45 is much larger than the impedance of heater coils 15, 17 and 19, and fan 21 the amount of current flowing through coils 15, 17 and 19 and fan 21 will be negligible, at most and there will essentially be no heat generated and the fan will not be "on". The amount of current flowing through lamp 79 and buzzer 81 will still be negligible (i.e. not enough to turn either one of these elements on) and the amount of current flowing through lamp 43 will not be sufficient to turn it on.

If the temperature in the room stays below the temperature setting on adjustable thermostat 35-2 and the unit is tipped beyond the predetermined angle set on tip sensor 35-1, then pendulum 63 will swing over and cause contacts 59 and 61 to open. Current will flow through signaling circuit 41, power lamp 43, fan 21 and heater coils 15, 17 and 19. Since adjustable thermostat 35-2 is closed, only a negligible current will flow through capacitor 45. Since power lamp 43 has a very high impedance relative to signalling circuit 41, most all of the current will flow through signalling circuit 41 rather than power lamp 43. Thus, lamp 43 will not be lit. Also, because the impedance of buzzer 81 is much higher than the resistance of the heater coils only negligible current will go through coils 15, 17 and 19. As a result, lamp 79 will light and buzzer 81 will sound. If the temperature inside heater 11 exceeds the temperature sitting on fuse 39, then the same results will occur except that resettable thermal fuse 39 will open rather than tip switch 35-1.

If a fault (excessive internal temperature or excessive tilt) occurs while adjustable thermostat 35-2 is open then sufficient current will flow through capacitor 45 to activate lamp 79 and buzzer 81 but not to generate more than negligible heat from coils 15, 17 and 19 and fan 21 will not "on".

If selector switch 23 is moved to a low heat position the same results will occur for each case noted above except that no current will flow through coil 15.

If selector switch 23 is in either one of the "fan-only" positions, no current will flow through any of the heater coils. Any resulting faults will "turn off" fan 21.

As can be appreciated, tip sensor 35-1 simultaneously deactivates heater circuit 13 and fan 21 and activates lamp 79 and buzzer 81 when it is opened and fuse 39 simultaneously deactivates heater circuit 13 and fan 21 and activates lamp 79 and buzzer 81 when it is opened.

By way of example only, the following are values of certain components in heater circuit 11.

Heater circuit 13 . . . 9.6 ohms (Impedance)
Capacitor 45 . . . 0.5 uf (250 VAC)
Buzzer 81 . . . 2.8 Kohms (Impendance)
Alarm Lamp 79 . . . 105 Kohms (Impendance)
Power Lamp 43 . . . 105 Kohms (Impedance)

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An electric heater circuit for an electric heater comprising:

a. heater coil means for generating heat, b. a temperature sensitive switch for reducing the amount of current flowing through the heater coil means when the temperature inside the electric heater exceeds a predetermined threshold temperature, the temperature sensitive switch being normally closed, c. a tilt sensitive switch for reducing the amount of current flowing through the heater coil means in response to tilting movement of the electric heater beyond a predetermined amount relative to a normal upright position, the tilt sensitive switch being normally closed, and d. signal means coupled in parallel with said temperature sensitive switch and said tilt sensitive switch for providing a signal directly in response to either the temperature sensitive switch being opened as a result of the temperature inside the electric heater exceeding the predetermined threshold temperature or the tilt sensitive switch being opened as a result of tilting movement of the heater beyond the predetermined amount relative to the normal upright position.

2. The electric heater circuit of claim 1 and further including an adjustable thermostat.

3. The electric heater circuit of claim 2 and further including a motor operated fan.

4. The electric heater circuit of claim 3 and wherein the circuit includes a capacitor.

5. The electric heater circuit of claim 4 and wherein the signal means includes a lamp and a buzzer.

6. The electric heater circuit of claim 5 and wherein the adjustable thermostat and tilt sensitive switch are a single unit.

7. An electric heater circuit for an electric heater comprising:

a. heater coil means for generating heat, b. a temperature sensitive switch for deactivating the heater means when the temperature inside the electric heater exceeds a predetermined threshold temperature, the temperature sensitive switch being normally closed, c. a tilt sensitive switch for deactivating the heater means in response to tilting movement of the electric heater beyond a predetermined amount relative to a normal upright position, the tilt sensitive switch being normally closed, and d. signal means coupled in parallel with said temperature sensitive switch and said tilt sensitive switch for providing a signal directly in response to either the temperature sensitive switch being opened as a result of the temperature inside the electric heater exceeding the predetermined threshold temperature or the tilt sensitive switch being opened as a result of tilting movement of the heater beyond the predetermined amount relative to the normal upright position.

8. An electric heater circuit for an electric heater comprising:

a. input means for connecting the electric heater circuit to a source of power, b. a temperature sensitive switch coupled between the input means and the heater means responsive to temperature inside the electric heater, the temperature sensitive switch being normally closed, the amount of current passing through the heater means depending in whether the switch is open or closed, c. a tilt sensitive switch coupled between the input means and the heater means responsive to tilting movement of the electric heater, the tilt sensitive switch being normally closed, the amount of current passing through the heater means depending on whether the switch is open or closed, and d. a signal means for providing a signal directly in response to either the temperature sensitive switch being opened or the tilt sensitive switch being opened.

9. An electric heater circuit for an electric heater comprising:

a. heater coil means for generating heat, b. a tilt sensitive switch for controlling the amount of current flowing through the heater coil means, said tilt sensitive switch reducing the amount of current flowing through the heater coil means in response to tilting movement of the electric heater beyond a predetermined amount relative to a normal upright position, and c. signal means under the control of said tilt sensitive switch for providing a signal directly in response to the heater being tilted beyond said predetermined amount relative to the normal upright position.

10. The electric heater circuit of claim 9 and further including an adjustable thermostat for controlling the amount of current flowing through the heater coil means.

11. The electric heater circuit of claim 9 and further including a motor operated fan for circulating air around and through the electric heater.

12. The electric heater circuit of claim 9 and wherein the circuit includes a capacitor having a very high impedance relative to the impedance of the signal means.

13. The electric heater circuit of claim 9 and wherein the signal means includes a lamp and a buzzer.

14. The electric heater circuit of claim 9 and wherein the adjustable thermostat and tilt sensitive switch are a single unit.

15. The electric heater circuit of claim 9 and wherein the tilt sensitive switch is a two position switch and is normally closed.

16. The electric heater circuit of claim 15 and wherein the tilt sensitive switch comprises a pendulum and a pair of contacts.

17. The electric heater circuit of claim 9 and further including a resettable thermal fuse for reducing the current flowing through the heater coil means when the temperature exceeds a predetermined threshold.

18. The electric heater circuit of claim 17 and wherein the signal means is also under the control of said resettable thermal fuse switch.

19. The electric heater circuit of claim 18 and wherein the resettable thermal fuse is a two position switch, one position being open and the other position being closed.

20. The electric heater circuit of claim 19 and further including a plug for connecting the electrical heater circuit to an external power source and a multi-position input switch means for connecting the plug to said heater coil means, the motor operated fan and the signal means.

21. The heater circuit of claim 9 and wherein said signal means is in a circuit in parallel with said tilt sensitive switch.

22. The heater circuit of claim 9 and wherein the heater circuit is an analog circuit.

* * * * *